US005662577A

United States Patent [19]

Reuteler

[11] Patent Number: 5,662,577

[45] Date of Patent: Sep. 2, 1997

[54] CARTON TRANSFER SYSTEM

[75] Inventor: Urs Reuteler, Kennesaw, Ga.

[73] Assignee: Riverwood International Corporation, Atlanta, Ga.

[21] Appl. No.: 549,989

[22] Filed: Oct. 30, 1995

[51] Int. Cl.[6] ..... B31B 1/80

[52] U.S. Cl. ..... 493/315; 493/318

[58] Field of Search ..... 493/309, 312, 493/313, 315, 316, 317, 318, 122, 123, 124; 414/736, 737; 271/91, 94, 95; 53/566, 381.1

[56] References Cited

U.S. PATENT DOCUMENTS

| | | | |
|---|---|---|---|
| 3,956,976 | 5/1976 | Vogel et al. | 493/315 |
| 4,194,442 | 3/1980 | Martelli | 493/123 |
| 4,881,934 | 11/1989 | Harston et al. | 493/315 |
| 5,019,029 | 5/1991 | Calvert | 493/315 |
| 5,061,231 | 10/1991 | Dietrich et al. | 493/315 |
| 5,067,937 | 11/1991 | Aschaber et al. | 493/315 |
| 5,078,669 | 1/1992 | Dietrich et al. | 493/315 |
| 5,102,385 | 4/1992 | Calvert | 493/315 |
| 5,105,931 | 4/1992 | Lashyro | 198/471.1 |
| 5,215,515 | 6/1993 | Bershadsky | 493/315 |
| 5,514,068 | 5/1996 | Calvert | 493/312 |
| 5,536,231 | 7/1996 | Nilsson | 493/312 |

*Primary Examiner*—Joseph J. Hail, III
*Assistant Examiner*—Darren Ark

[57] ABSTRACT

A carton transfer assembly having a rotary feeder that rotates a series of selectors about a transfer path between a carton feeder and a transport conveyor. The selectors each include vacuum engagement members adapted to engage a selected carton to remove the selected carton from the carton feeder and carry the carton toward a transport conveyor as the rotary feeder rotates the selectors about the transfer path. Each selector further includes stingers that are operated off of the vacuum applied to the cartons by the vacuum engagement members to move the stingers between extended and retracted positions. As the vacuum is applied to the stingers, the stingers are retracted. When the vacuum is disengaged, the stingers move to an extended position to engage and spread apart the panels of the cartons to open the cartons prior to the deposit of the cartons within the carton pockets of the transport conveyor.

21 Claims, 5 Drawing Sheets

CARTON TRANSFER SYSTEM

FIELD OF THE INVENTION

The present invention relates in general to a system for selecting and transporting a carton from a stack of cartons to a transport conveyor. In particular, the present invention relates to a carton transfer system having a series of selectors which engage and apply a pulling force against a selected carton to remove the carton from the stack of cartons. As the selected carton is moved toward the transport conveyor, the pulling force exerted on the carton is decreased, in response to which an extensible contact member engages and urges the walls of the carton to spread apart to open the carton for loading onto the transport conveyor, whereupon the pulling force is reestablished to cause the contact member to be retracted away from engagement with the carton as the carton is moved away by the transport conveyor.

BACKGROUND OF THE INVENTION

As the manufacture and production of goods has become more automated, it has become increasingly desirable to automate other facets of the production of goods, especially the packaging of goods. One particular area of interest has been in the packaging of goods in cartons such as the packaging of soft drink cans or bottles, etc., in cardboard cartons, such as for beverage "twelve-packs". As a part of an automated packaging operation, the cartons generally are selected from a stack of cartons in which the cartons are stacked one on top of another in a substantially flat orientation. The cartons are pulled from the stack and transferred to a transport conveyor. Along the way, the cartons must be spread apart into an opened position prior to placement within the carton pockets of the transport conveyor. The transport conveyor carries the opened cartons to a packaging station wherein the opened cartons are packed with products such as cans of soft drinks, etc.

The principal problem encountered in transferring cartons from a flat stacked arrangement to the carton pockets of the conveyor has been in accomplishing the steps of selecting, opening and loading the cartons in as expediently and efficiently a manner as possible. In the past, conventional carton transfer assemblies generally have used a series of vacuum cups mounted on a rotating frame. The vacuum cups are rotated into engagement with a substantially vertically oriented stack of cartons and apply a suction force or vacuum against adjacent panels of the cartons to pull the cartons from the stack. These prior art carton transfer assemblies further typically include stabilizing members, known as "stingers" that engage rear panels of the cartons during the transfer process. The stingers tend to urge the rear panels of the cartons away from the carton front panels to cause the cartons to be spread apart into an opened arrangement.

For example, U.S. Pat. Nos. 5,105,931 of Lashyro and 5,019,029 of Calvert both disclose carton transfer or control assemblies that include suction or vacuum cups that engage and pickup collapsed sleeve type cartons from a flat stack of cartons. The vacuum cups transfer the cartons to a transport conveyor in which the cartons are loaded in an opened, spread apart configuration. Lashyro further discloses the use of stabilizing members or stingers that are received through and engage the cartons at cutouts in the front panels thereof to spread apart the panels of the carton and open the carton.

Problems arise, however, with the use of conventional stingers for spreading and opening the cartons during a transfer operation. As illustrated in the Lashyro, U.S. Pat. No. 5,105,931, most conventional stingers typically comprise spring-biased rods or pins mounted adjacent the vacuum cups of the system. The springs bias the stingers into engagement with the rear panels of the cartons to spread the panels of the cartons to open the cartons. Conventional article transfer assemblies generally have relied upon the stingers being moved against the force of their springs into a retracted position by the weight of the carton stack as the vacuum cups are moved into engagement therewith. Thereafter, the force of the vacuum being pulled through the vacuum cups against the panels of the cartons has been used to pull against the force of the springs to maintain the stingers in their retracted, out of the way positions.

A problem, however, arises when the stack of cartons gradually is lessened by the removal of cartons therefrom, which reduces the weight of the carton stack. As the weight of the carton stack is decreased, the biasing force of the springs of the stingers no longer is overcome by the weight of the stack, but instead the stacked cartons tend to be pushed away from the vacuum cups by the extended stingers. As a result, the vacuum cups miss picking or engaging the cartons, or only partially engage the cartons so that the transfer and loading operation is disrupted and/or the cartons are damaged. Additionally, the length of most conventional stingers generally has been limited in order to avoid engagement with the panels of the cartons during the picking of the cartons from the stack and the unloading of the opened cartons into the carton pockets of the conveyors. Such engagement can tear and/or cause damage to the panels of the cartons, requiring the cartons to be discarded.

These problems are magnified as the speed of the carton transfer assembly is increased. Accordingly, the rate of transfer of cartons from a flat stacked arrangement into an opened configuration positioned within the carton pockets of a transport conveyor generally has been limited with conventional transfer systems, and such systems typically have had to be constantly and carefully monitored to ensure their proper and efficient functioning.

Accordingly, it can be seen that a need exists for a carton transfer assembly for transferring canons from a flat stacked arrangement to a transfer conveyor which includes stingers for engaging, urging and spreading apart the panels of the cartons to open the carton in which the stingers are automatically retracted as the cartons are picked up and loaded into the carton pockets of a transport conveyor so as to minimize the danger of the panels of the canons being engaged and damaged by the stingers and to avoid the mispicking of the cartons by the vacuum engagement cups to enable the faster and more efficient transfer of the cartons.

SUMMARY OF THE INVENTION

Briefly described, the present invention comprises a carton transfer assembly for transferring cartons formed from cardstock, paper or similar materials from a flat, stacked arrangement to a transport conveyor, with the cartons being deposited on the transport conveyor in a spaced apart, opened configuration. The carton transfer assembly includes a rotary feeder having carton selectors mounted in spaced series thereabout. The selectors select and pull individual cartons from the stack of cartons, and carry the cartons toward the transport conveyor along a transport path as the selectors are rotated by the rotary feeder.

The rotary feeder generally includes a support frame comprising first and second stationary side plates mounted to a base. A main shaft is extended between the side plates, and includes a first end rotatably mounted to the first side plate and a second end extending through the second side plate coupled in a driving relationship to a drive motor. The drive motor rotates the main shaft to rotate the rotary feeder about its transport path. A series of rotary plates are mounted to the main shaft and rotate therewith. The rotary plates are substantially square-shaped and generally are formed from metal or similar material. The carton selectors are rotatably mounted in spaced series along the outer edges of the rotary plates and thus are rotated about the transport path with the rotation of the main shaft.

Primary and secondary vacuum valve assemblies are mounted on the main shaft adjacent the proximal and distal ends thereof. The primary and secondary vacuum valve assemblies each include a stationary valve plate that is rotatably mounted to the main shaft and secured to a side plate so as to remain fixed in place as the main shaft rotates. A rotating valve plate is mounted near each end of the main shaft adjacent each stationary valve plate, and rotate with the rotary plates. Each stationary valve plate is connected to a vacuum pump for supplying a vacuum therethrough. The stationary valve plates and the rotating valve plates further each has a series of ports formed through their facing surfaces. As the rotating valve plates rotate, the ports of the rotating and stationary valve plates tend to become aligned to enable a vacuum to be drawn therethrough. The rotating vacuum plates each are connected to the selectors to supply a vacuum or pulling force to the selectors.

A drive means for rotating the selectors independently of the rotation of the rotary feeder is mounted adjacent the second end of the drive shaft. The drive means includes a large stationary center gear that is mounted to a stationary gear support, secured against the rotation with the main shaft. Idler gears are rotatably mounted about the center gear in meshing engagement with the center gear. The idler gears are positioned in series about the circumference of the stationary center gear, aligned with the selectors, with the teeth of the idler gears in meshing engagement with the teeth of the stationary center gear.

Selector shaft gears are mounted to the selectors, positioned above and in meshing engagement with the idler gears. As the rotary feeder is rotated, the idler gears are rotated about the stationary center gear. In turn, the idler gears cause the selector shaft gears to be rotated in the opposite direction. As a result, the selector shaft gears rotate the carton selectors in an opposite direction from the rotation of the rotary feeder as the rotary feeder rotates about its transport path.

Typically, four carton selectors are mounted to the rotary plates of the rotary feeder, positioned at the four corners thereof, although additional or fewer carton selectors can be used as desired. Each selector includes a series of vacuum engagement members, which include primary vacuum cups and secondary vacuum cups that generally are positioned immediately adjacent one another in pairs. The primary and secondary vacuum cups each comprise a suction cup mounted at the end of an elongated vacuum shaft. Rotary vacuum ports are are connected to the rotating valve plates of the primary and secondary vacuum assemblies, and communicate with the selectors for supplying a vacuum or pulling force to the primary and secondary vacuum cups. The primary and secondary vacuum cups are rotated into engagement with adjacent panels of a carton, with the secondary vacuum cups engaging a first panel or portion of the selected carton and the primary cups engage a second panel or portion of the carton. The primary and secondary vacuum cups apply a vacuum or pulling force against the panels of the carton to pick a selected carton from the stack of cartons.

Additionally, contact members or stingers are mounted to the selector shafts with each pair of primary and secondary vacuum cups, positioned adjacent and aligned with the primary vacuum cups. Each of the stingers includes a rod or pin and a bellows to which the rod is mounted. The bellows generally are formed from a pair of suction cups, including an upper suction cup and a lower suction cup, mounted in an opposing, facing relationship. The lower suction cup is mounted to the stinger rod, and the upper section cup is mounted to the stinger bracket and communicates with a vacuum valve. The vacuum valve is connected to the same vacuum port of the selector shaft as are the secondary vacuum cups.

As a vacuum is drawn through the secondary vacuum cups, the bellows are collapsed to contract the stinger rod into a retracted non-engaging position. As the vacuum force is reduced or disengaged from the secondary cup, the vacuum force applied through the bellows likewise is discontinued. The reduction or disruption of the vacuum applied to the secondary vacuum cup and stinger causes the bellows to expand and move the stinger rod to its extended, engaging position, into engagement with a rear panel or wall of the carton. The stinger rod urges the rear panel away from the front panel of the carton being held by the primary vacuum cup. The panels of the carton thus are spread apart to open the carton as the carton is rotated toward the transport conveyor.

DETAILED DESCRIPTION OF THE DRAWINGS

Figure 1:
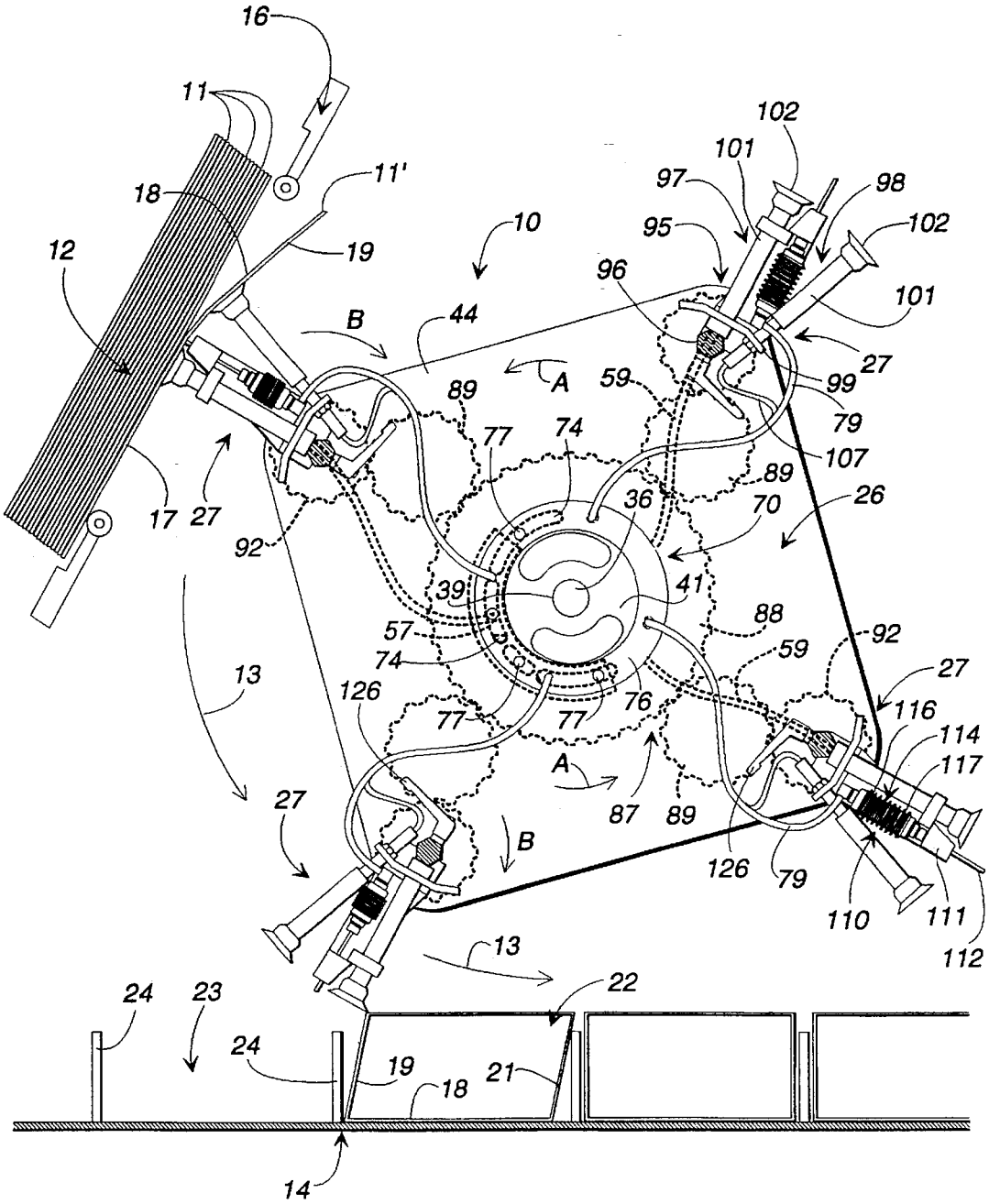
FIG. 1 is a schematic view illustrating the carton transfer assembly of the present invention, and showing a carton being removed from a flat stack of cartons and deposited onto a transfer conveyor.

Referring now in greater detail to the drawings in which like numerals indicate like parts throughout the several views, FIG. 1 illustrates a carton transfer assembly 10 for transferring cartons 11 from a carton stack 12 along a transfer path, indicated by arrows 13, to a transport conveyor 14. As illustrated in FIG. 1, the cartons are stacked one on top of another in a substantially vertically oriented carton feeder 16 positioned above the transport conveyor 14. Each carton generally is substantially rectangularly shaped and includes a front panel 17, a rear panel 18 and side panels 19 and 21, and includes angled cutout portions 22 (FIG. 2) formed between the side panels 19 and 21 and the front and rear panels 17, 18 of the cartons 11. The cartons are opened as they are transferred from their flat stacked, compacted arrangement, as illustrated in FIG. 1, along their transfer path 13 by the carton transfer assembly 10. The opened cartons are deposited within a carton pocket 23 of the transport conveyor 14 engaged by chain lugs 24.

Figure 2:
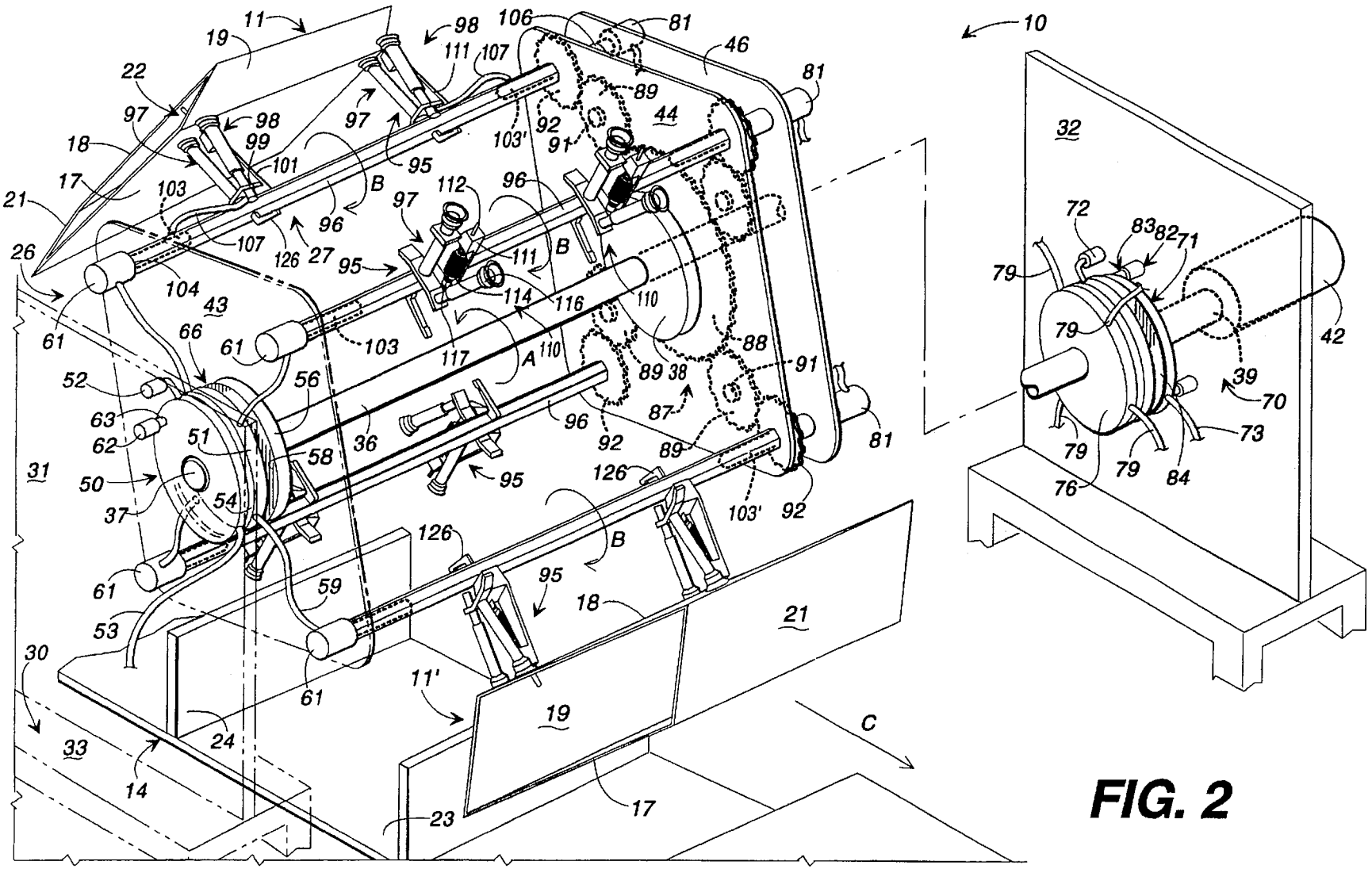
FIG. 2 is a perspective view of the rotary feeder of the carton transfer assembly of FIG. 1, with certain parts removed for clarity.

As FIGS. 1 and 2 illustrate, the carton transfer assembly 10 includes a rotary feeder 26 having a series of selectors 27 mounted in spaced series about the outer edge of the rotary feeder. The rotary feeder generally is substantially square-shaped, as illustrated in FIG. 1, and typically includes four selectors mounted thereto. The rotary feeder is rotated in the direction of arrows A, carrying the selectors along the arcuate transfer path 13. The selectors additionally are rotated independently of the rotary feeder, rotating in the direction of arrows B. The selectors are rotated into engagement with the carton stack 12 and pickup and carry selected cartons, such as carton 11' from the carton stack about the transfer path 13, and deposit the cartons within the carton pockets 23 of the transport conveyor 14.

The rotary feeder is rotatably mounted to a support frame 30, as illustrated in FIG. 2. The support frame 30 includes first and second stationary side plates 31, 32 between which the rotary feeder is received and rotates, and a base 33 to which the side plates 31 and 32 are mounted. The support frame supports the rotary feeder in a position spaced above the transport conveyor 14.

As illustrated in FIG. 2, the rotary feeder 26 generally includes a main shaft 36 that extends approximately centrally through the side plates. The main shaft includes a first end 37 that extends through and is rotatably attached to the first side plate 31 by a bushing or hub 38, and a second end 39 (FIG. 1) that projects from the second side plate 32 and is attached to the second side plate by a bushing or hub 41. A drive motor 42 is coupled to the second end 39 of the main shaft 36 in a driving relationship. The drive motor rotates the main shaft in a substantially counterclockwise direction in the direction of arrows A to rotate the rotary feeder about its transfer path as indicated in FIG. 1.

A series of rotary plates 43, 44 and 46 are fixedly mounted to the main shaft 36 adjacent the side plates 31 and 32. As FIG. 2 illustrates, rotary plate 43 is mounted adjacent the first side plate 31, spaced inwardly therefrom, and rotary plates 44 and 46 are mounted adjacent the second side plate 32, with rotary plates 44 and 46 being spaced from one another. As FIG. 1 illustrates, the rotary plates generally are substantially square-shaped plates, although it will be understood by those skilled in the art that the plates can be formed in various other shapes, between which the selectors are mounted at the corners thereof, and are rotated in the direction of arrows A with the rotation of the main shaft.

A primary vacuum assembly 50 is positioned between the first side plate 31 (FIG. 2) and rotary plate 43, supported on the main shaft 36 adjacent its first end thereof. The primary vacuum assembly 50 includes a circularly shaped stationary valve plate 51 rotatably mounted about the main shaft so as to remain in place as the main shaft rotates. A bracket 52 is mounted to the first side plate and is attached to an upper end of the stationary valve plate. The bracket 52 helps support the stationary valve plate in a fixed position about the main shaft as the main shaft is rotated. A vacuum hose or conduit 53 connects to the lower end of the stationary valve plate and to a vacuum pump (not shown) for supplying a vacuum to the stationary valve plate. Additionally, a series of ducts or ports (not shown) are formed in the inwardly facing surface 54 of the stationary valve plate 51.

A rotating valve plate 56 is positioned between the stationary valve plate 51 and rotary plate 43 and is fixedly mounted to the main shaft so as to rotate therewith. Like the stationary valve plate 51, the rotating valve plate 56 is substantially circularly shaped and includes a series of vacuum ports 57 (shown in dashed lines in FIG. 1) formed in its outwardly facing surface 58 that faces toward the stationary valve plate. As the rotating valve plate is rotated with the main shaft, its ports become aligned with the ports formed in the stationary valve plate to supply a vacuum to the rotating valve plate. A series of vacuum hoses or conduits 59 are mounted to the side surfaces of the rotating valve plate and connect the rotating valve plate to primary rotary ports 61 for each of the selectors 27.

A spring retainer 62 is mounted to the first side plate 31, and extends inwardly toward the stationary valve plate 51. The spring retainer includes a compression spring 63 which engages and urges the stationary valve plate toward tight sliding contact with the rotating valve plate. Additionally, a wear plate 66 is mounted between the stationary and rotary valve plates. The wear plate generally is formed from nylon or similar material that reduces friction and enables the easy sliding rotation of the rotating valve plate thereover to maintain a substantially air-tight seal between the stationary and rotating valve plates during the rotation of the rotary feeder.

Figure 3B:
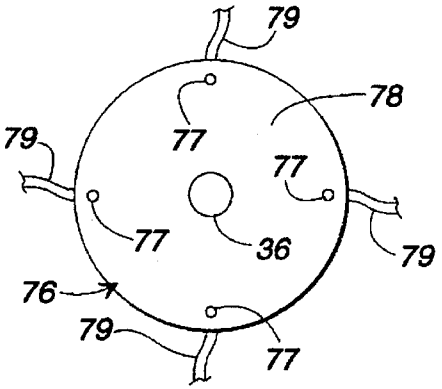
FIG. 3B is a cross-sectional view of the secondary valve assembly, illustrating the parts of the rotating valve plate.
Figure 3A:
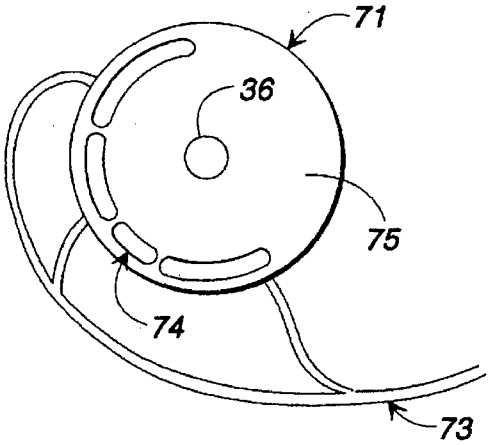
FIG. 3A is a cross-sectional view of the secondary vacuum assembly, illustrating the parts of the stationary vacuum plate.

As illustrated in FIG. 2, a secondary vacuum assembly 70 is mounted on the main shaft 36 adjacent the second side plate 32. The secondary vacuum assembly is of substantially similar construction to that of the primary vacuum assembly 50, including a stationary valve plate 71 rotatably mounted to the main shaft by a bearing that enables the main shaft to rotate without the stationary plate rotating therewith. A support bracket 72 is mounted to the second side plate 32 and attaches to the stationary valve plate 71. Support bracket 72 fixes the stationary plate in stationary position to prevent the rotation of the stationary valve plate with the main shaft. A vacuum hose or conduit 73 (FIGS. 2 and 3A) is attached to a side surface of the stationary valve plate and connects the stationary valve plate to a vacuum pump (not shown). The stationary valve plate further includes a series of ports 74 formed in an inwardly facing surface 75 thereof and through which a vacuum force is supplied.

The secondary vacuum assembly further includes a rotating valve plate 76 (FIG. 3B) mounted to the main shaft 36 adjacent the inwardly facing surface 74 of the stationary valve plate 71. The rotating valve plate is fixed to the main shaft so as to rotate therewith, and includes a series of ports 77 formed in a surface 78 facing the stationary valve plate. The ports 77 are generally small, substantially circular openings formed at spaced intervals about the periphery of the rotating valve plate. As the rotating valve plate is rotated in the direction of arrows A, its vacuum ports 77 tend to become aligned with the vacuum ports 74 (FIG. 3A) of the stationary valve plate 71 so that the vacuum or pulling force being supplied through the stationary valve plate passes through the rotating valve plate.

Vacuum conduits 79 (FIG. 2) connect the rotating valve plate with a series of secondary ports 81. Generally, there is a secondary rotary port 81 for each of the selectors 27 of the current transfer assembly. The vacuum or pulling force supplied through the stationary valve plate to the rotary valve plate is communicated to the secondary rotary port by the vacuum conduits and thus to the selectors.

A spring retainer 82 is mounted to the second side plate 32, positioned between the second side plate and the stationary valve plate. The spring retainer includes a compression spring 83 that projects from the spring retainer and engages the stationary valve plate 71, tending to urge or bias the stationary valve plate inwardly toward the rotating valve plate 76. A wear plate 84 is positioned between the stationary and rotating valve plates 71 and 76 with the stationary and rotating valve plates engaging the wear plate. The wear plate generally is formed from nylon or a similar material having reduced friction surfaces so that as the rotating valve plate is rotated with the main shaft, the facing surface 78 of the rotating valve plate tends to slide over the wear plate with a substantially air-tight seal being maintained therebetween to avoid disruption of the vacuum force being drawn through the stationary and rotating valve plates.

A drive means 87 is mounted about the main shaft 36, positioned between rotary plates 44 and 46 as shown in FIG. 2. The drive means includes a large, stationary central gear 88, which is fixedly mounted with the machine frame so that it remains stationary with respect to the main shaft as the main shaft is rotated in the direction of arrows A. A series of idler gears 89 are rotatably mounted between the rotary plates 44 and 46 (FIG. 2) in meshing engagement with the stationary central gear 88. As FIGS. 1 and 2 illustrate, typically four idler gears are provided, one for each of the selectors of the system. The idler gears are rotatably mounted on idler gear shafts 91 which are attached to the rotary plates 44 and 46 (FIG. 2). As the main shaft is rotated, causing the rotary plates to rotate about in the direction of arrows A, the idler gears are moved about the central gear along a substantially circular path in the direction of arrows A, causing the idler gears to be rotated as the teeth of the idler gears mesh with the teeth of the central gear.

A series of selector gears 92 are mounted in contact with the idler gears 89 in meshing engagement therewith. The selector gears are rotatably mounted between the rotary plates 44 and 46, each connected to a selector 27 of the carton transfer assembly 10. As the rotary feeder is rotated, causing the idler gears to revolve about the stationary central gear and rotate in the direction of arrows A, the selector gears are caused to rotate in the opposite direction so as to rotate the selectors in the direction of arrows B (FIGS. 1 and 2).

As FIGS. 1 and 2 illustrate, each of the selectors 27 includes a series of vacuum engagement members 95 mounted at spaced positions along a selector shaft 96. The vacuum engagement members generally include a primary vacuum cup or member 97 and a secondary vacuum cup or member 98. Typically, the primary and secondary vacuum cups are arranged in pairs as illustrated in FIG. 1 with the secondary vacuum cups canted slightly from the orientation of the primary vacuum cups. The primary and secondary vacuum cups each typically include a support base 99 that mounts the primary and secondary vacuum cups to the selector shaft 96, an elongated vacuum shaft 101 mounted to and extending from the base, and suction cups 102 mounted to the free ends of the vacuum shafts 101. The suction cups 102 generally are formed from rubber or similar material that enables an air-tight seal to be formed between the suction cups and the carton panels.

The primary and secondary vacuum cups are connected to the primary and secondary vacuum assemblies 50 and 70 (FIG. 2), respectively, which supply a vacuum or pulling force through the suction cups of the primary and secondary vacuum cups. Typically, as the selectors are rotated in the direction of arrows B, the secondary vacuum cups tend to engage the cartons 11 (FIG. 1) first, engaging side panel 19 and pulling the side panel from the carton feeder 16 as the primary cup is rotated into engagement with and pulls front panel 17 from the stack 12 of cartons 11 in the carton feeder.

As FIG. 2 illustrates, the selector shafts 96 on which the vacuum engagement members 95 are mounted extend between and are rotatably mounted to the rotary plates 43, 44 and 46, and rotate in the direction of arrows B independently of the rotation of the rotary plates in the direction of arrows A by the main shaft 36. The selector shafts include vacuum ducts 103 and 103' (shown in dashed lines) formed at the ends 104 and 106 of the vacuum shafts and extending partially along the length thereof. The vacuum ducts 103 and 103' communicate with the primary and secondary rotary ports 61 and 81, which supply a vacuum thereto. Vacuum hoses or conduits 107 connect the vacuum ducts 103 and 103' of the selector shafts with the vacuum shafts 101 of the primary and secondary vacuum cups 97 and 98. The primary vacuum cups are linked to the vacuum ducts 103 that are in communication with the primary rotary ports, while the secondary vacuum cups are linked to the vacuum ducts 103' connected to the secondary rotary ports. As a result, each primary vacuum cup of the selectors is connected to the primary vacuum assembly 50 and each secondary cup 98 of the selectors is connected to the secondary vacuum assembly 70.

Figure 4A:
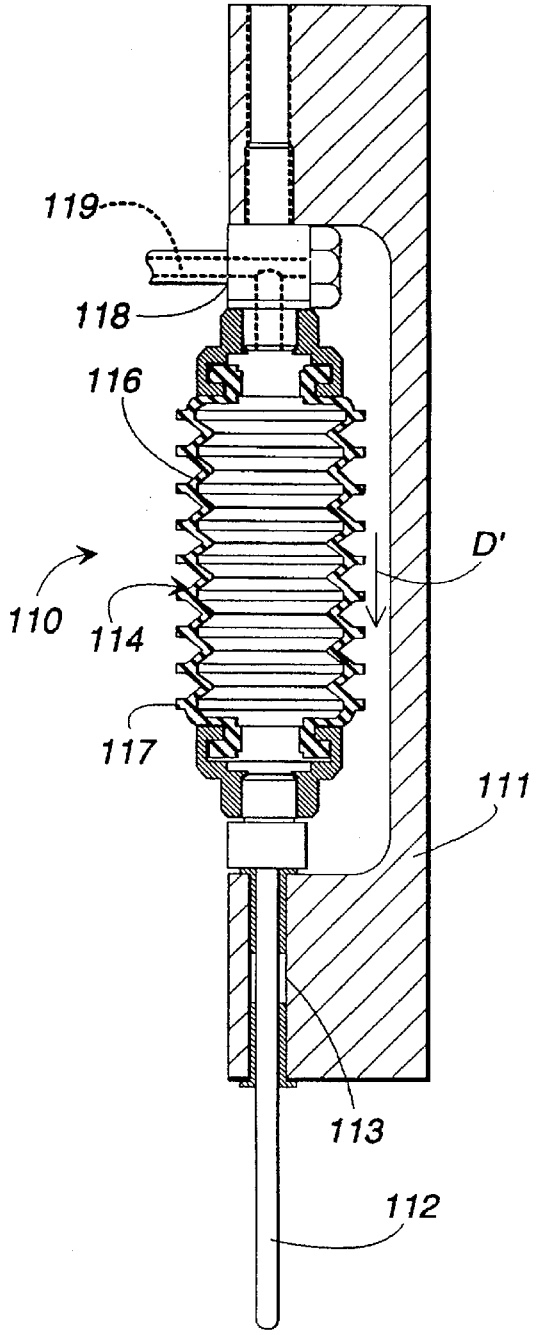
FIG. 4A is a cross-sectional view of the stinger assembly with the stinger rod extended.
Figure 4B:
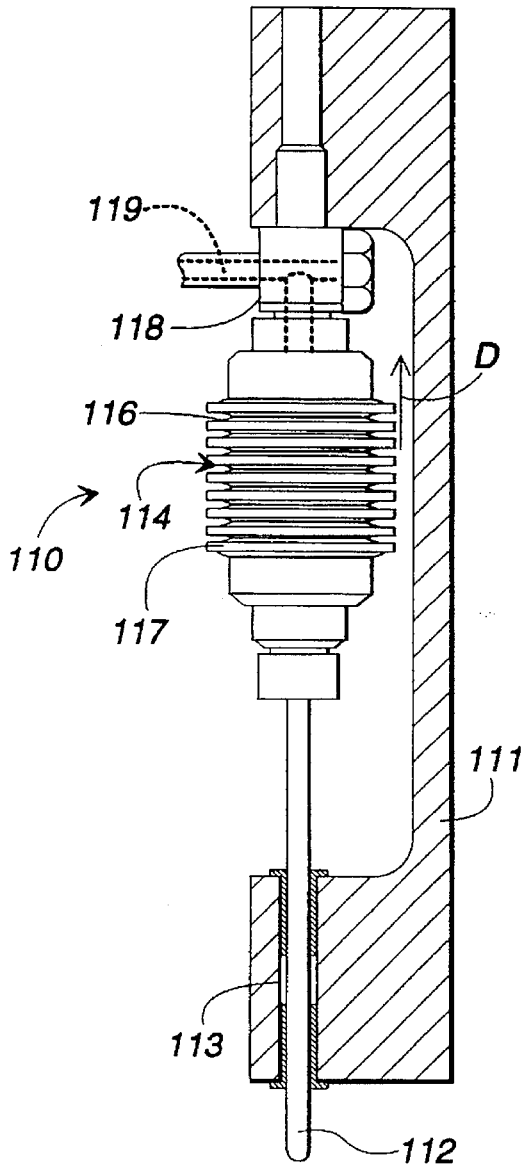
FIG. 4B is a cross-sectional view of the stinger assembly with the bellows compressed and the stinger rod retracted.

As shown in FIG. 1, each of the selectors 27 additionally includes stingers or contact members 110 adjustably mounted to the selector shafts adjacent the primary vacuum cups 97. The stingers are received within adjustable support brackets 111, which are mounted parallel to the primary vacuum cups. As illustrated in FIGS. 4A and 4B, each stinger includes a stinger rod or shaft 112 that is extensible through a passage 113 formed in each support bracket 111 at the lower end thereof, and a bellows assembly 114 which retracts and extends the stinger rod through the passage 113. The bellows 114 generally comprises a pair of suction cups 116 and 117. The suction cups are formed from rubber or similar material and are mounted in an opposed, facing relationship. The upper suction cup 116 is mounted to a vacuum fitting 118 positioned at the upper end of the support bracket and includes a vacuum passage 119 formed therethrough. The lower suction cup 117 faces upwardly toward the upper suction cup 116 and is connected to the stinger rod 112 at its lower end. As schematically illustrated in FIG. 1, the vacuum valve for the upper suction cup is connected to the vacuum duct 103' (FIG. 2) to which the secondary vacuum cups 98 are attached, and thus are connected to the secondary vacuum assembly 70. As a result, as the vacuum or pulling force is drawn through the secondary vacuum cups, a pulling force likewise is drawn through the vacuum fittings 118 and vacuum passages 119 of the stingers. This pulling force cause the upper and lower suction cups to be drawn together and compressed, as illustrated in FIG. 4B, so as to retract the stinger rod 112 in the direction of arrow D from its extending engaging position shown in FIGS. 1 and 4A into its retracted, non-operative position illustrated in FIGS. 1 and 4B.

As the pulling force or vacuum being drawn through the secondary vacuum assembly is disrupted by the continued rotation of the rotary feeder, the natural resilience of the bellows tends to cause the bellows to decompress and move downwardly in the direction of arrows D' (FIG. 4A). As a result, the stinger rod is urged into its extended, operative position in which the stinger rod engages the rear panel 18 (FIG. 2) of a carton 11 being held by the selector through a cutout portion 22 thereof. The extension of the stinger rods against the cartons urges the rear panels of the cartons away from the front panel, causing the cartons to be spread apart into an opened configuration as the cartons approach the transport conveyor 14 (FIG. 1).

Additionally a scale (not illustrated) is printed on each of the selector shafts along an intermediate portion of the length of each selector shafts. The scale generally is a metric scale and provides a means for precisely positioning the vacuum engagement members of each selector along the length of the selector shafts to accommodate the desired spacing therebetween for proper engagement and transport of the cartons. An adjustment handle 126 (FIG. 1) is mounted to the support bracket for each of the stingers at the connection of the support bracket to its selector shaft. The adjustment handles enable the lateral adjustment of the stinger brackets to adjust the orientation and position of the stingers to ensure that the stingers properly engage the cartons at the cutout portions thereof.

OPERATION

In operation of the carton transfer assembly 10 (FIGS. 1 and 2), the rotary feeder 26 is rotated in the direction of arrows A which move a series of selectors 27 about a transfer path 13 (FIG. 1) between the stack 12 of cartons 11 and a transport conveyor 14. As the rotary feeder is rotated in the direction of arrows A, idler gears 89 engage and move about a stationary central gear 88, causing the idler gears to rotate in the direction of arrows A. The rotation of the idler gears in turn causes the rotation of selector gears 92 connected to each of the selectors 27 in the direction of arrows B. As a result, the selectors are rotated in an opposite direction from the rotation of the rotary feeder, as indicated in FIG. 1. Thus, the secondary vacuum cups 98 of each selector are rotated into engagement with a selected carton of the stack of cartons first, with the primary vacuum cups 97 of each selector 27 engaging the selected carton after the secondary vacuum cups.

Figure 5C:
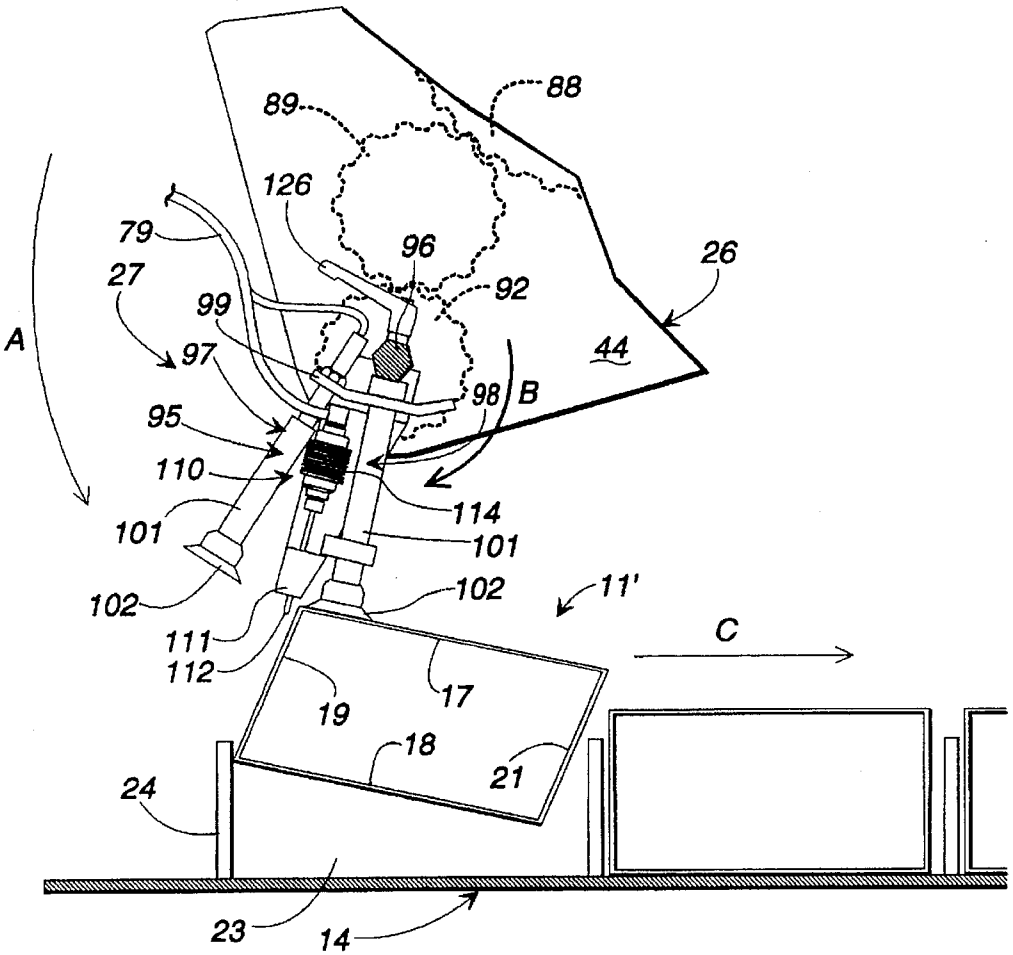
FIGS. 5A–5C are schematic views illustrating the process by which a carton is removed from a stack of cartons with a carton in a flat, compacted arrangement, and is opened and deposited onto the transport conveyor.

As each selector is rotated into engagement with the stack of cartons, the ports of the rotating valve plates 56 and 76 (FIG. 2) of the primary and secondary vacuum assemblies 50 and 70, respectively, are rotated into alignment with the ports formed through the facing surfaces of the stationary valve plates 51 (FIG. 2) and 71 of primary and secondary vacuum assemblies. As schematically illustrated in FIG. 1, with the ports of the stationary and rotating valve plates of the primary and secondary vacuum assemblies aligned, a vacuum or pulling force is communicated to and drawn through the primary and secondary vacuum cups of each selector. Thus, as illustrated in FIGS. 1 and 5A, as the primary and secondary vacuum cups are rotated into engagement with a first side panel 19 and a from panel 17 of a selected carton 11', a pulling force is applied to the carton panels to draw or pick the carton panels from the carton feeder 16.

At the same time the vacuum or pulling force is being applied through the secondary vacuum cups to engage and pull a first side panel 19 of the selected carton 11' from the stack of cartons, a vacuum or pulling force also is supplied to the stingers 110 of each selector. As illustrated in FIG. 4B, as a vacuum is drawn through the bellows 114 of the stingers, the upper and lower suction cups 116 and 117 are drawn together in a compressed, compacted arrangement. The compression of the bellows causes the stinger rod 112 to be retracted through the passage 113 of its stinger support bracket 111. As a result, the stinger rod is maintained in a retracted, non-engaging position, illustrated in FIG. 1. The retraction of the stinger rod prevents the stinger rods from engaging the cartons as the panels of the cartons are engaged and pulled from the carton feeder by the primary and secondary vacuum cups. This ensures that the engagement of the carton panels by the primary and secondary vacuum cups is not disturbed or otherwise prevented by the stinger rods to avoid misfeeding or mispicking of the cartons from the stack of cartons by the selectors.

Figure 5B:
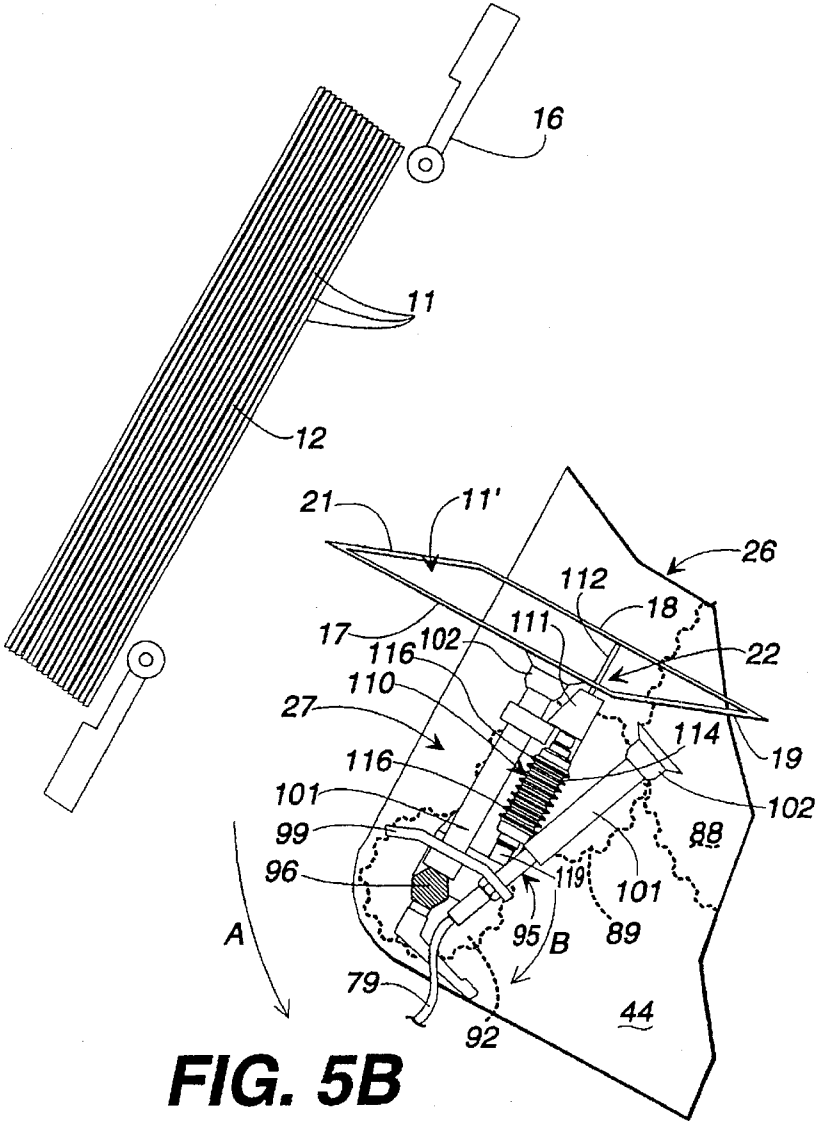
Figure 5A:
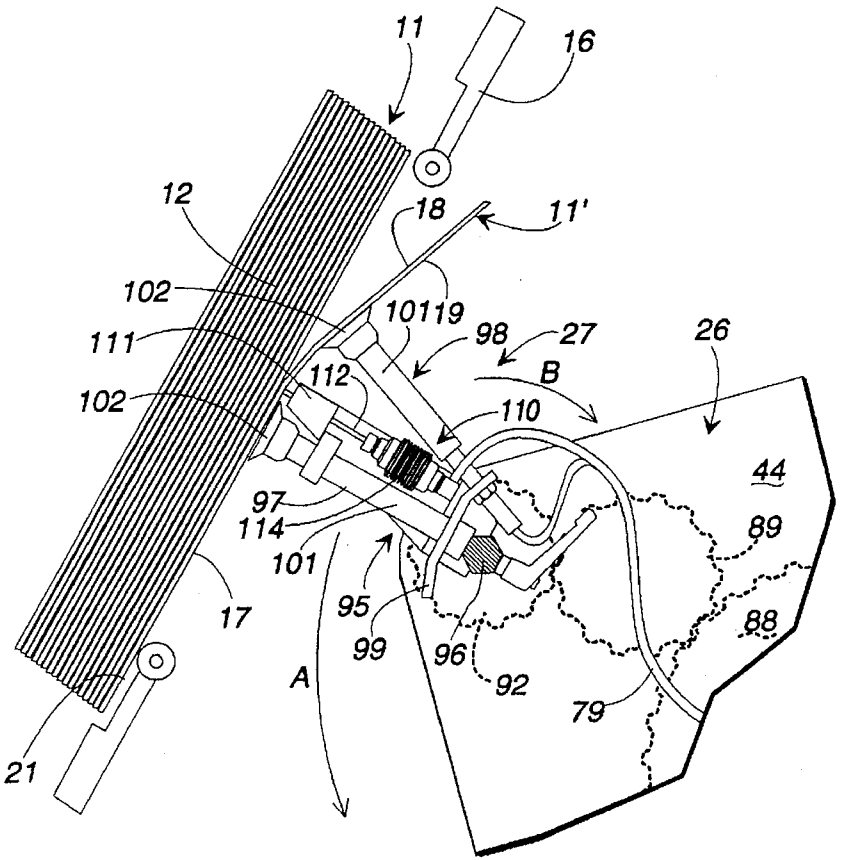

As illustrated in FIGS. 1 and 5B, after the selected carton 11' has been picked from the stack of cartons the carton is moved along the transfer path in the direction of arrow A by the continued rotation of the rotary feeder. At the same time, the carton is rotated in the direction of arrow B by its selector. Thereafter, as the selected carton is moved along its transfer path, the vacuum ports of the rotating valve plate 76 (FIG. 2) of the secondary vacuum assembly 70 are moved out of alignment with the vacuum ports formed in the stationary vacuum plate 71 of the secondary vacuum assembly.

The misalignment of the ports of the stationary and rotating valve plates causes the vacuum or pulling force being drawn through the secondary vacuum assembly to be disrupted. As a result, the pulling force applied to the first side panel 19 (FIG. 5B) by the secondary vacuum cup 98 such that the first side panel 19 of the selected carton 11' is released from engagement by the secondary vacuum cup. At the same time, the disruption of the vacuum force applied through the secondary vacuum cup causes the disruption of the vacuum force applied to the bellows 114 of the stinger 110 of the selector. Without the vacuum or pulling force being applied therethrough, the natural resilience of the upper and lower suction cups 116 and 117 of the bellows causes the suction cups to expand and urge the stinger rod formed in the stinger support bracket 111 into its engaging position (shown in FIGS. 4A and 5B).

As the stinger rod is extended, the stinger rod engages and urges the rear panel 18 of the selected carton 11' rearwardly, away from the front panel 17 thereof, separating the front and rear panels, as shown in FIG. 5B. The separation of the front and rear panels causes the carton to be spread apart into an opened configuration. Further, as the rear panel of the carton is urged away from the front panel, the front panel continues to be held by the primary vacuum cup as the carton is rotated and moved toward an open carton pocket 23 of the transport conveyor 14.

As illustrated in FIGS. 1 and 5C, as the now opened carton approaches an open carton pocket 23 of the transport conveyor 14, the vacuum ports 77 of the rotating valve plate of the secondary vacuum assembly are rotated into alignment with additional vacuum ports formed in the stationary valve plate of the secondary vacuum assembly. The further alignment of the vacuum ports causes the vacuum or pulling force of the secondary vacuum assembly to be reasserted. The reassertion of the vacuum through the secondary vacuum assembly causes a vacuum again to be the drawn through the bellows 114 of the stingers. The bellows accordingly are compressed, causing the stinger rods of the stingers to be pulled inwardly into their retracted, nonengaging positions as illustrated in FIGS. 1 and 5C. Thus, the stinger rods are retracted and maintained out of engagement with the carton panels as the opened cartons are deposited within an open carton pocket of the transport conveyor. This prevents the cartons from being engaged by the stinger rods and becoming damaged or dislodged from the transport conveyor.

Additionally, at the point where the stinger rods are again retracted as the cartons are deposited within the transport conveyor, the suction cups 102 of the secondary vacuum cups are disengaged from the carton and thus are open to the atmosphere. However, due to the small size of the port opening formed in the suction cup in relation to the vacuum force being applied therethrough, the pulling of a vacuum through the stingers is not disrupted or otherwise retarded by the opening of the suction cups of the secondary vacuum cups to the atmosphere.

As the now open carton approaches the open carton pocket of the transport conveyor, a side panel 19 of the carton 11' is engaged by a chain lug 24 of the transport conveyor. The pusher plate tends to engage and urge the side panel of the carton forwardly in the direction of arrow C, as the carton is rotated toward the transport conveyor and the transport conveyor moves forwardly The engagement of the side panel by the chain lug causes the carton to be further spread apart to complete the opening of the carton as the carton is deposited within the open carton pocket of the conveyor. The vacuum port 57 (FIG. 1) of the rotating valve plate 56 of the primary vacuum assembly 50 subsequently is moved out of alignment with the vacuum port of the stationary valve plate 51 of the primary vacuum assembly, causing the disruption of the vacuum or pulling force being drawn through the primary vacuum cup 97. The from panel 17 of the carton is thus released from engagement with the primary vacuum cup, the carton continues forwardly in the direction of arrow C with the transport conveyor for conveying to an additional processing station for packing with cans of soft drinks, etc. The selectors of the rotary feeder continue to rotate about their transport path, selecting, opening and depositing cartons from the stack of cartons within the carton pockets of the transport conveyor.

Accordingly, it can be seen that the present invention advantageously provides a carton transfer assembly in which the stingers or contact members for opening the cartons prior to the deposit of the cartons within their transport conveyor are automatically retracted as the cartons are selected from the stack of cartons and are deposited within their transport conveyor. Such an automatic retraction of the stingers is accomplished using the same vacuum or pulling force used to pickup and transport the cartons and without relying upon the weight of the cartons to retract the stingers. Thus, the carton transfer assembly of the present invention can be operated at a faster rate to increase the packaging and thus production of articles with the danger of misfeeding or disruption of a carton transfer and opening operation being minimized. Additionally, the present invention can be applied to existing carton transfer assemblies as a retrofit or upgrade thereto and thus is simple and economical to install and use.

It will be understood by those skilled in the art that while the invention has been disclosed with reference to a preferred embodiment, various additions, deletions, and modifications can be made thereto without departing from the spirit and scope of the present invention as set forth in the following claims.

I claim:

1. A carton transfer assembly for transferring cartons from a stacked, substantially flat orientation to a conveyor on which the cartons are placed in an expanded, opened orientation, comprising:

a rotary feeder rotatable about a central axis;

means for engaging and picking a carton from a stack of cartons mounted to and rotatable with said rotary feeder to remove the carton from the stack of articles and carry the carton toward the conveyor as said rotary feeder is rotated;

vacuum means connected to said means for engaging and picking and selectively operable for supplying a suction force to said means for engaging and picking the carton from the stack of cartons and holding the carton during transport; and means for opening the carton mounted adjacent said means for engaging and picking and connected to said vacuum means such that said means for opening the carton is maintained in a retracted, nonoperative position out of engagement with the carton being held by said means for engaging as said vacuum means supplies a suction force to said means for engaging and picking, and is moved into an extended, operative position in engagement with the carton to open the carton as said vacuum means is deactivated.

2. The carton transfer assembly of claim 1 and wherein said means for engaging and picking comprises a primary vacuum engagement means rotatably mounted to said rotary feeder and connected to said vacuum means, and a secondary vacuum engagement means rotatably mounted to said rotary feeder adjacent said primary vacuum engagement means and connected to said vacuum means.

3. The carton transfer assembly of claim 2 and wherein said primary vacuum engagement means and said secondary vacuum engagement means are supplied with a suction force by said vacuum means at overlapping intervals.

4. The carton transfer assembly of claim 1 and wherein said means for opening the carton includes a support bracket adjacent said means for engaging and picking, an extensible rod mounted to said support bracket and movable from a retracted, nonoperative position to an operative, engaging position extended from said support bracket, and means for urging said rod into its extended, operative position.

5. The carton transfer assembly of claim 4 and wherein said means for urging said rod comprises a resilient bellows connected to said vacuum means such that as said vacuum means supplies a suction force to said means for engaging and picking the carton, said bellows is compressed to retract said rod.

6. The carton transfer assembly of claim 1 and wherein said rotary feeder includes a series of selectors rotatably mounted to said rotary feeder and to which said means for engaging and picking and said means for opening the carton are mounted.

7. The carton transfer assembly of claim 1 and wherein said vacuum means comprises a vacuum pump, a stationary vacuum valve having a series of vacuum ports, and vacuum conduits connected to said means for engaging and picking a carton and adapted to selectively engage said vacuum ports.

8. The carton transfer assembly of claim 2 and wherein said primary vacuum engagement means comprises a pair of spatially aligned, parallel primary vacuum cups, and said secondary vacuum engagement means comprises a pair of spatially aligned, parallel secondary vacuum cups.

9. A method of transferring a carton from a stack of cartons to a transport conveyor, comprising the steps of:

applying a first vacuum to a first portion of the carton and moving the first portion of the carton from the stack;

as the first portion of the carton is moved from the stack, applying a second vacuum at a second portion of the carton and moving the second portion of the carton from the stack;

disengaging the first vacuum applied to the first portion of the carton as the carton is moved along a transport path;

as the first vacuum is disengaged from the first portion of the carton, engaging the carton with a contact member to urge the carton into an opened configuration;

as the carton approaches the transport conveyor, reengaging the first vacuum directed toward the first portion of the carton to cause the contact member to be retracted; and loading the carton onto the transport conveyor.

10. The method of claim 9 wherein the steps of applying a vacuum at first and second portions of the carton comprise engaging the first portion of the carton with a secondary vacuum member and engaging the second portion of the carton with a primary vacuum member.

11. The method of claim 9 and wherein the step of applying a vacuum at a first portion of the carton includes urging and holding the contact member in a retracted position out of engagement with the carton while the vacuum is applied to the first portion of the carton.

12. The method of claim 9 and wherein the step of moving the carton along a transport path comprises the steps of rotating a carton selector into engagement with the carton and moving the selector about a substantially circular transport path with the rotation of a rotary feeder.

13. The method of claim 10 and further including the step of moving vacuum conduits connected to the primary and secondary vacuum members into and out of communication with vacuum ports for selectively engaging and disengaging the vacuum applied to the primary and secondary vacuum members.

14. The method of claim 9 and wherein the step of engaging the carton with a contact member comprises releasing the contact member from a retracted, non-engaging position as the vacuum is disengaged and urging the contact member toward the carton.

15. The method of claim 9 and further including the step of disengaging the vacuum from the second portion of the carton as the carton is loaded onto the transport conveyor.

16. The method of claim 9 and wherein the step of loading the carton onto the transport conveyor further includes the step of disengaging the vacuum from the second portion of the carton.

17. The method of claim 9 and wherein the step of loading the carton onto the transport conveyor comprises rotating the carton into a carton pocket of the transport conveyor, engaging and urging the carton forwardly as the transport conveyor moves forwardly, and disengaging the vacuum from the second portion of the carton.

18. An article transfer system for moving articles from a stack of articles to a transport conveyor and having primary and secondary vacuum engagement members through which a suction force is drawn for selectively engaging and pulling articles from the stack of articles and holding the articles as the articles are moved toward the transport conveyor, the improvement therein comprising:

a contact member mounted adjacent the vacuum engagement members and communicating with a vacuum supply means for the secondary vacuum engagement member such that as the suction force is applied to the article through said secondary vacuum engagement member, said contact member is moved to an extended, operative position, engaging the article to urge the article into a spread apart, open position.

19. The article transfer system of claim 18 and wherein said contact member comprises an elongated rod.

20. The article transfer system of claim 18 and further including bellows attached at one end to said contact member and whereby communication of said bellows with the vacuum supply for the secondary vacuums engagement member effects moving said contact members between a retracted position and an extended position.

21. The article transfer system of claim 18 and further including a support bracket within which said contact member is slidably mounted.

* * * * *